US007390292B2

(12) United States Patent
Held et al.

(10) Patent No.: US 7,390,292 B2
(45) Date of Patent: Jun. 24, 2008

(54) PUNCTURE CYLINDER PROVIDED WITH AT LEAST ONE PUNCTURE STRIP

(75) Inventors: Michael Held, Heuchelheim (DE); Sebastian Alois Prüm, Kaiserslautern (DE); Holger Ratz, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 98 days.

(21) Appl. No.: 10/561,794

(22) PCT Filed: Jun. 25, 2004

(86) PCT No.: PCT/EP2004/051251

§ 371 (c)(1),
(2), (4) Date: Dec. 21, 2005

(87) PCT Pub. No.: WO2005/003009

PCT Pub. Date: Jan. 13, 2005

(65) Prior Publication Data

US 2006/0191432 A1 Aug. 31, 2006

(30) Foreign Application Priority Data

Jul. 2, 2003 (DE) ..... 103 29 672

(51) Int. Cl.
*B31F 1/00* (2006.01)

(52) U.S. Cl. ..... 493/432; 493/428

(58) Field of Classification Search ..... 493/432, 493/424, 425, 428, 443
See application file for complete search history.

(56) References Cited

U.S. PATENT DOCUMENTS

| | | | | |
|---|---|---|---|---|
| 1,626,592 | A * | 5/1927 | Andersen | 270/50 |
| 2,775,171 | A * | 12/1956 | Steen et al. | 493/226 |
| 3,263,988 | A * | 8/1966 | Heimlicher | 270/50 |
| 4,190,242 | A * | 2/1980 | Bolza-Schunemann | 270/50 |
| 4,445,881 | A * | 5/1984 | Bullen et al. | 493/424 |
| 4,790,804 | A * | 12/1988 | Gotou et al. | 493/226 |
| 5,503,071 | A | 4/1996 | Hillebrand et al. | |
| 5,807,227 | A * | 9/1998 | Field | 493/424 |
| 6,843,763 | B2 * | 1/2005 | Jackson et al. | 493/428 |
| 6,869,388 | B2 * | 3/2005 | Kostiza | 493/424 |
| 6,895,858 | B2 * | 5/2005 | Kostiza et al. | 101/219 |
| 2003/0110968 | A1 | 6/2003 | Jackson et al. | |

FOREIGN PATENT DOCUMENTS

| | | |
|---|---|---|
| DE | 2 025 347 | 6/1971 |
| DE | 2 126 610 | 2/1972 |
| DE | 43 40 858 | 2/1998 |
| DE | 100 18 775 | 10/2001 |
| EP | 0 019 202 | 11/1980 |
| GB | 343368 | 2/1931 |

* cited by examiner

*Primary Examiner*—Sameh H. Tawfik
(74) *Attorney, Agent, or Firm*—Jones, Tullar & Cooper, PC

(57) ABSTRACT

A puncture or gripper cylinder is provided with at least one puncture strip that is provided with gripper pins or point needles. These pins are extendable from the cylinder to puncture and to grip a signature. At least one deflector is carried on the puncture cylinder and is extendable and retractable with respect to a surface of the cylinder. The deflector, when it is extended at least temporarily shields the signature from subsequent pins.

8 Claims, 7 Drawing Sheets

PUNCTURE CYLINDER PROVIDED WITH AT LEAST ONE PUNCTURE STRIP

CROSS-REFERENCE TO RELATED APPLICATIONS

This application is the U.S. national phase, under 35 USC 371, of PCT/EP2004/051251, filed Jun. 25, 2004; published as WO 2005/003009 A1 on Jan. 13, 2005, and claiming priority to DE 103 29 672.7, filed Jul. 2, 2003, the disclosures of which are expressly incorporated herein by reference.

FIELD OF THE INVENTION

The present invention is directed to a spur cylinder with at least one spur strip. The spur cylinder includes deflectors which can be extended at selected times.

BACKGROUND OF THE INVENTION

In the course of operating a folding apparatus, the front or leading end sections of signatures are speared or impaled on the spur needles of a spur strip which is carried by a spur cylinder or a puncture cylinder. The speared, impaled or spurred signatures are drawn by the rotating spur cylinder through a transfer gap which is formed by the spur cylinder and by a cooperating folding jaw cylinder which has been placed against the spur cylinder. In the transfer gap, a signature is grasped by the folding jaws of the folding jaw cylinder. At the same time, the spur strip is pivoted into its recessed position and in this way releases the signature. Upon its release from the spur strip, the front portion of the released signature slides across a shell face of the spur cylinder opposite to the direction of rotation of the spur cylinder. In the course of this, the danger arises that this signature front portion, as it passes over following spur needles of a further or, depending on the circumference of the spur cylinder, the same spur strip, on which a second signature has been speared, will be damaged by them. The danger of damage to the signature is particularly great in connection with delta folding production. In this case, approximately two-thirds of a portion of the signature is located in front of the folding blade, and one third of a portion of the signature is located behind the folding blade.

A spur cylinder with additional grippers, which act on the leading edge of the signature, is known from DE 43 40 585 C2. Since, in that device, the spur needles are retracted after the additional grippers have made contact, the danger of damage being done to the removed signature by subsequent spur needles does not occur.

DE 100 18 775 A1, DE 21 26 610 A1 and DE 20 25 347 A1 all disclose strippers for use in lifting signatures off the spur needles. A protective function is not provided by these devices, since these strippers act from below the speared signature.

EP 0 019 202 A1 discloses a spur cylinder with spur coverings. No detailed information regarding possible positions or movements of these spur coverings is provided.

SUMMARY OF THE INVENTION

The object of the present invention is directed to providing a spur cylinder with at least one spur strip.

The object is attained in accordance with the invention by the provision of a spur cylinder that has at last one spur strip which is used to engage leading ends of signatures. At least one deflector is arranged on the spur cylinder and can be extended and retracted. The spur cylinder forms a transfer gap in cooperation with a folding jaw cylinder. The extension and retraction of the at least one deflector is coordinated with the passage of the at least one deflector through the transfer gap.

End sections of signatures, which have been released from the spur cylinder, are grasped by the folding jaw cylinder, are pulled off the spur cylinder by rotation of the folding jaw cylinder, and brush over the shell face of the spur cylinder opposite its direction of rotation. These signature end sections are kept away from the spur needles of a following second spur strip by a deflector, which deflector extends away from the surface of a spur cylinder at least some of the time. The signatures are protected by the use of this deflector against damage by a second or subsequent spur strip.

Advantageously, the deflector can be retracted into, and can be extended from the spur cylinder. For example, the deflector can be in a retracted state, in order not to be interfering, in the course its passage through a transfer gap, which cylinder gap is formed by the spur cylinder and a folding jaw cylinder. After having passed through the transfer gap, the deflector can be extended in order to be able to perform the above-discussed protective action for protecting backward-moving signature sections. The deflector can again be retracted when the spur strip is retracted, in order to be ready for its next passage through the transfer gap. In this case, the retraction and extension of the deflector can be controlled by the use of a generally known cam disk, such as is also used, for example, for retracting and extending spur needles and folding blades.

The deflector can be a strip that is extending in a direction which is axis-parallel in respect to the spur cylinder. This strip can extend over the entire width of the spur cylinder, or can extend over only a portion of the width of the spur cylinder. If the strip-shaped deflector extends over only a portion of the spur cylinder width, the spur cylinder can also have a plurality of similar deflectors, which plurality of deflectors are arranged staggered over the cylinder width. Moreover, a strip-shaped deflector can be provided with cutouts, so that it has teeth like a comb. In this case, the teeth can be respectively assigned to spur needles of a spur strip.

The deflector advantageously has a radial projection, with respect to the spur needles of one of the spur strips, for an effective protective effect. It is assured, in this way, that the backward or the retrograde moving end sections of the signatures will brush over the spur needles without touching them. In this connection, it is also possible to embody the deflector for covering the spur needles.

In a folding apparatus which is used with a spur cylinder in accordance with the present invention, the deflector is preferably arranged ahead of one of the spur strips, in the direction of rotation of the spur cylinder. It is thus located between this spur strip and the backward or retrograde moving end section of the signature and thereby shields the signature end section from the spur needles of the spur strip. In this case, the deflector preferably has an inclined face which is pointing away from a shell face of the spur cylinder and opposite the direction of rotation of the spur cylinder, so that the backward or retrograde moving end section of the signature can possibly slide on and over this inclined face.

BRIEF DESCRIPTION OF THE DRAWINGS

Preferred embodiments of the present invention are represented in the drawings and will be described in what follows.

Shown are.

DESCRIPTION OF THE PREFERRED EMBODIMENTS

Figure 1:
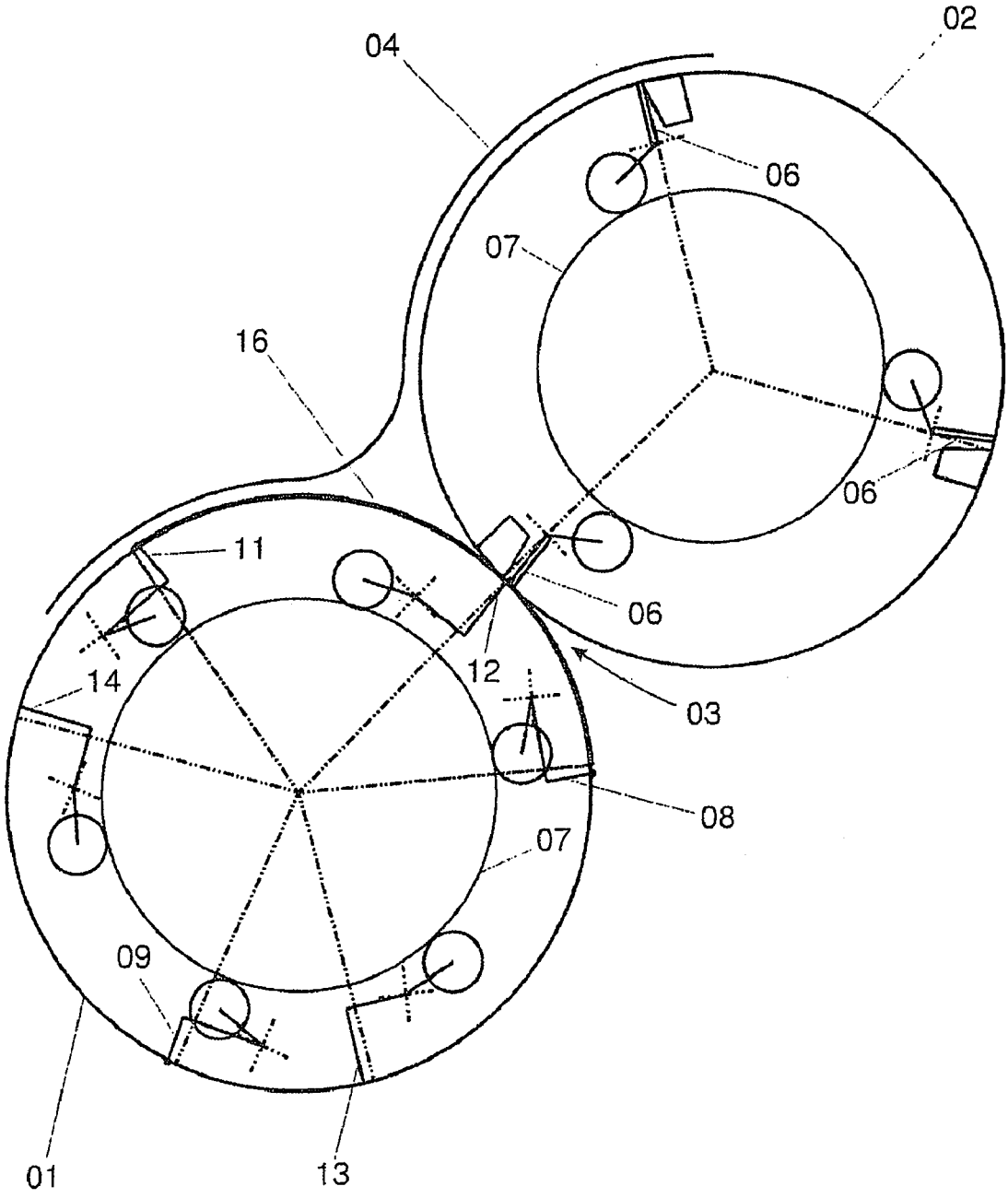
FIG. 1, a generally conventional arrangement of a spur cylinder with a folding jaw cylinder placed against it, and with a signature being held on the spur cylinder by spur needles, in FIG. 2, the arrangement depicted in FIG. 1, with the signature in the process of being released, FIG. 3, the arrangement depicted in FIG. 1 and directly following the release of the signature from the spur cylinder, FIG. 4, an arrangement of a folding jaw cylinder and a spur cylinder in accordance with the present invention, and with a signature being held against it by spur needles, FIG. 5, the arrangement depicted in FIG. 4, and directly following the release of the signature, FIG. 6, an enlarged representation of a backward or retrograde moving section of the signature from FIG. 5, and FIG. 7, an enlarged perspective representation of a portion of the spur cylinder and folding jaw cylinder depicted in FIG. 6

A schematic cross section, taken through a generally known arrangement utilizing a rotatable spur cylinder 01 and a rotatable folding jaw cylinder 02, is shown in FIG. 1. Both cylinders 01, 02 have been placed against each other and define a transfer gap 03. A sheet metal guide plate 04 is arranged at the outlet of the transfer gap 03, which guide plate 04 substantially follows the contours of the two cylinders 01, 02. The folding jaw cylinder 02 has three folding jaws 06, which folding jaws 06 are operated in a generally known manner by the use of a cam disk 07. Spur strips 08, 09, 11 with extensible spur needles, and extensible folding blades 12, 13, 14 are arranged in an alternating manner on the spur cylinder 01. As was the case with the folding jaws 06, the movement of each of the spur strips 08, 09, 11 and each of the folding blades 12, 13, 14 is controlled by a cam disk 07. A leading end section of a signature 16, which leading end section lies in front, with respect to a direction of rotation of the spur cylinder 01, rests against the shell face of the spur cylinder 01. The signature itself extends on both sides of the transfer gap 03. The signature leading end is speared on the spur needles of the spur strip 11.

FIG. 1 depicts a stop motion view just prior to the signature 16 being picked up off the spur cylinder 01 by a folding jaw 06 of the folding jaw cylinder 02. In the transfer gap 03, the signature 16 is pushed, by the extending folding blade 12, into the folding jaw 06 of the folding jaw cylinder 02. At this time, the spur needles of the spur strip 11 have been previously retracted and have released the signature 16. In the course of what is referred to as delta folding, the signature 16, which is to be displaced opposite the direction of rotation of the spur cylinder 01 at a ratio of ⅔ to ⅓, is grasped by the folding jaw 06. In a not-represented variation of the present invention, the signature 16 is grasped, while it is slightly shifted off-center opposite the direction of rotation of the spur cylinder 01, by the folding jaw 06. The reason for this is that the front or leading end section of the signature, in which the signature 16 had been speared or impaled on the spur needles of the spur strip 11, is later cut off. This is done in order to remove the puncture holes which were made by the spur needles.

Figure 2:
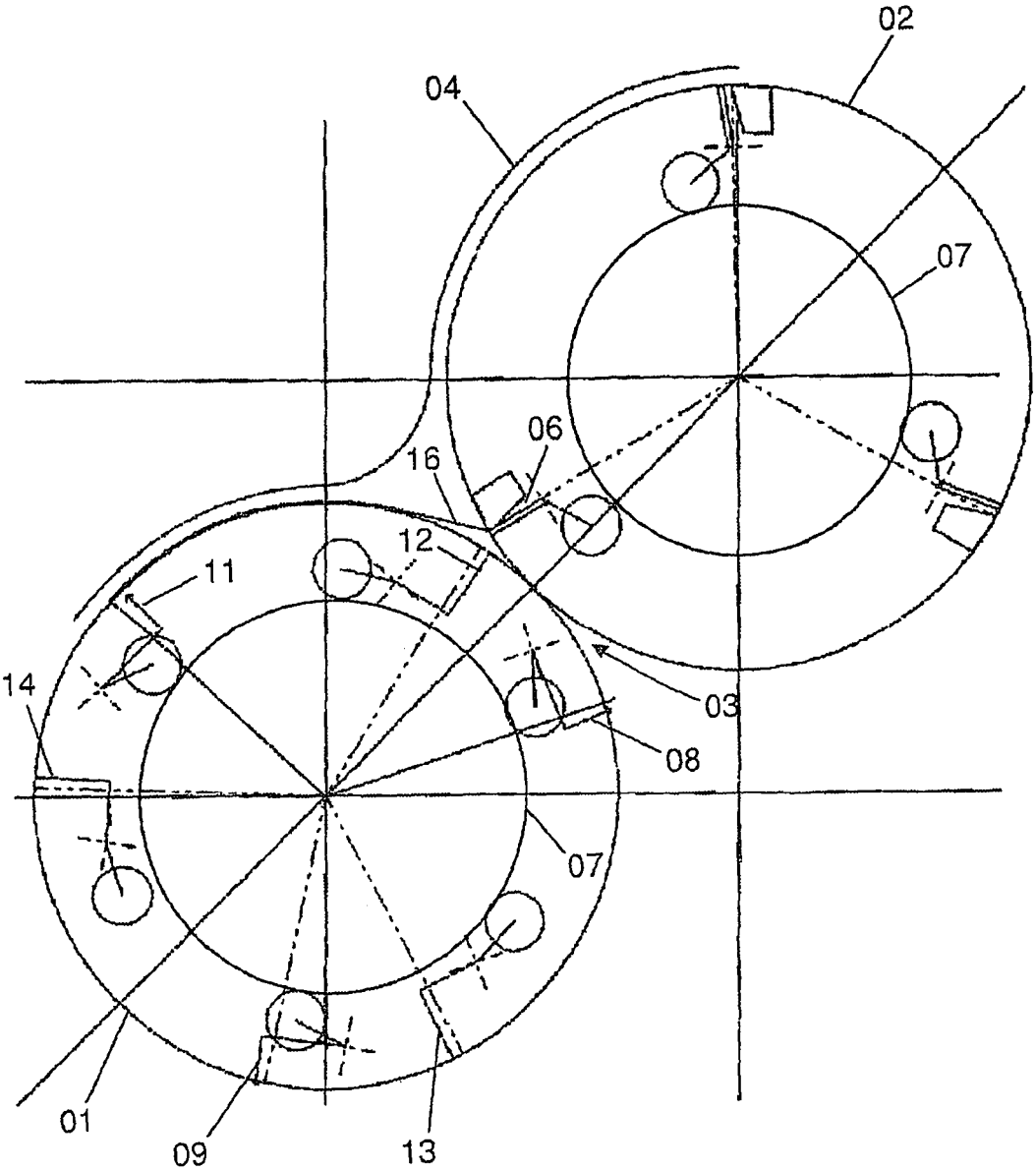

A configuration, which occurs a short time after the grasping of the signature 16 by the folding jaw 06, is represented in FIG. 2. In this depiction, the spur cylinder 01 and the folding jaw cylinder 02 have continued to rotate further for a short period of time and distance. The signature 16, which has been grasped by the folding jaw 06, begins to be released from the shell face of the spur cylinder 01. However, the entire signature 16 has not yet passed completely through the transfer gap 03. The folding blade 12 has again been retracted into the spur cylinder 01. The spur needles of the spur strip 11, which had held the leading end of signature 16 have also been retracted. The end section of the signature 16 is accordingly released.

Figure 3:
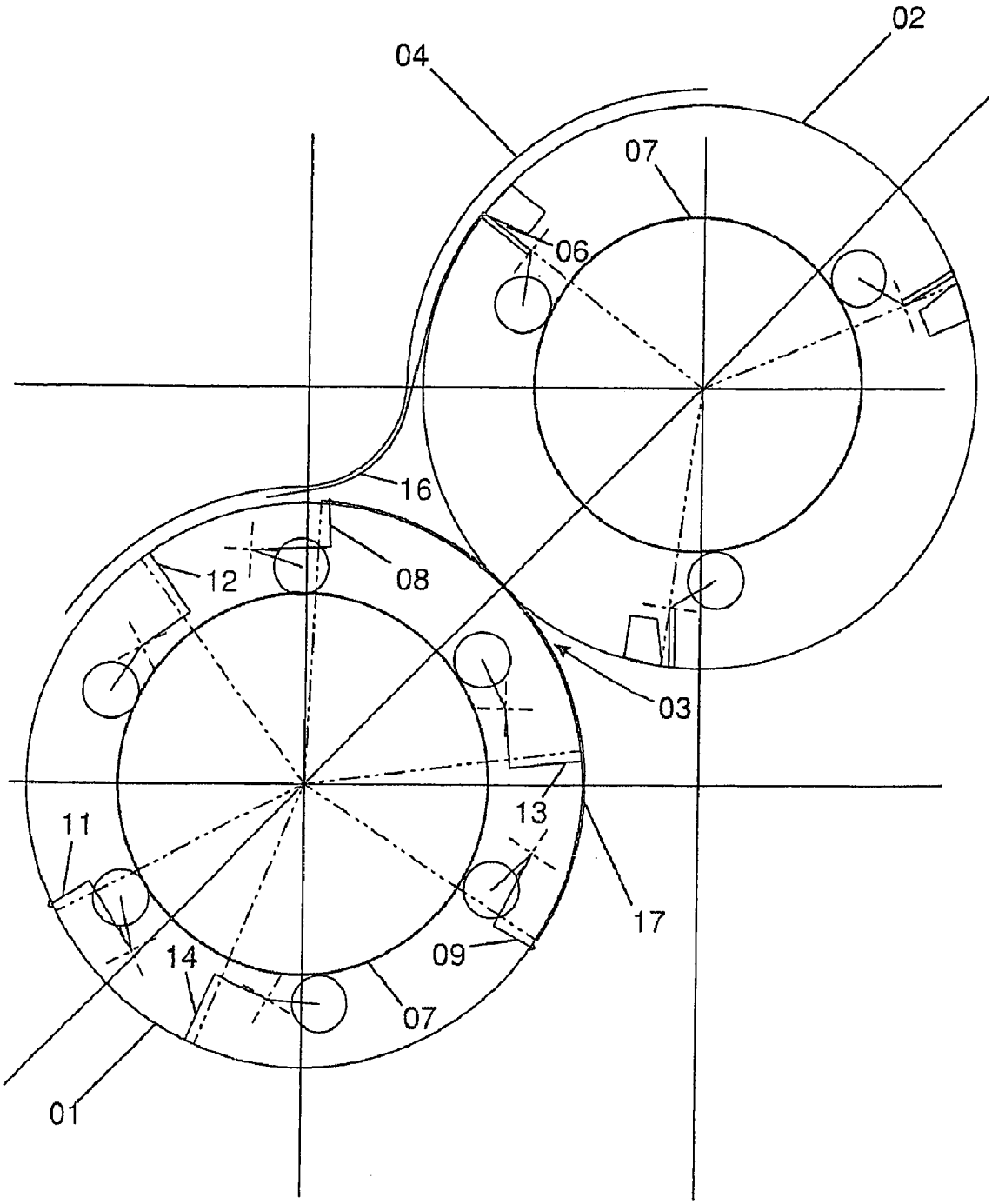

In the course of subsequent rotation of the spur cylinder 01, and of the cooperating folding jaw cylinder 02, the signature 16 is taken along by the folding jaw cylinder 02. The sheet metal guide plate 04 stretches the signature 16 and prevents the formation of folds. Before the signature 16 is completely removed from the spur cylinder 01, the spur needles of the next following spur strip 08 have already passed through the transfer gap 03. This is depicted in FIG. 3. A second signature 17 is speared or impaled on the spur needles of the next following spur strip 08. In the course of this cylinder rotation, the now released, originally leading end section of the first signature 16 which, because of the pulling effect of the folding jaw cylinder 02 runs opposite to the direction of rotation of the spur cylinder 01, now brushes over the extended spur needles of the next following spur strip 08 and, in the course of this contact, risks the danger of being damaged.

Figure 4:
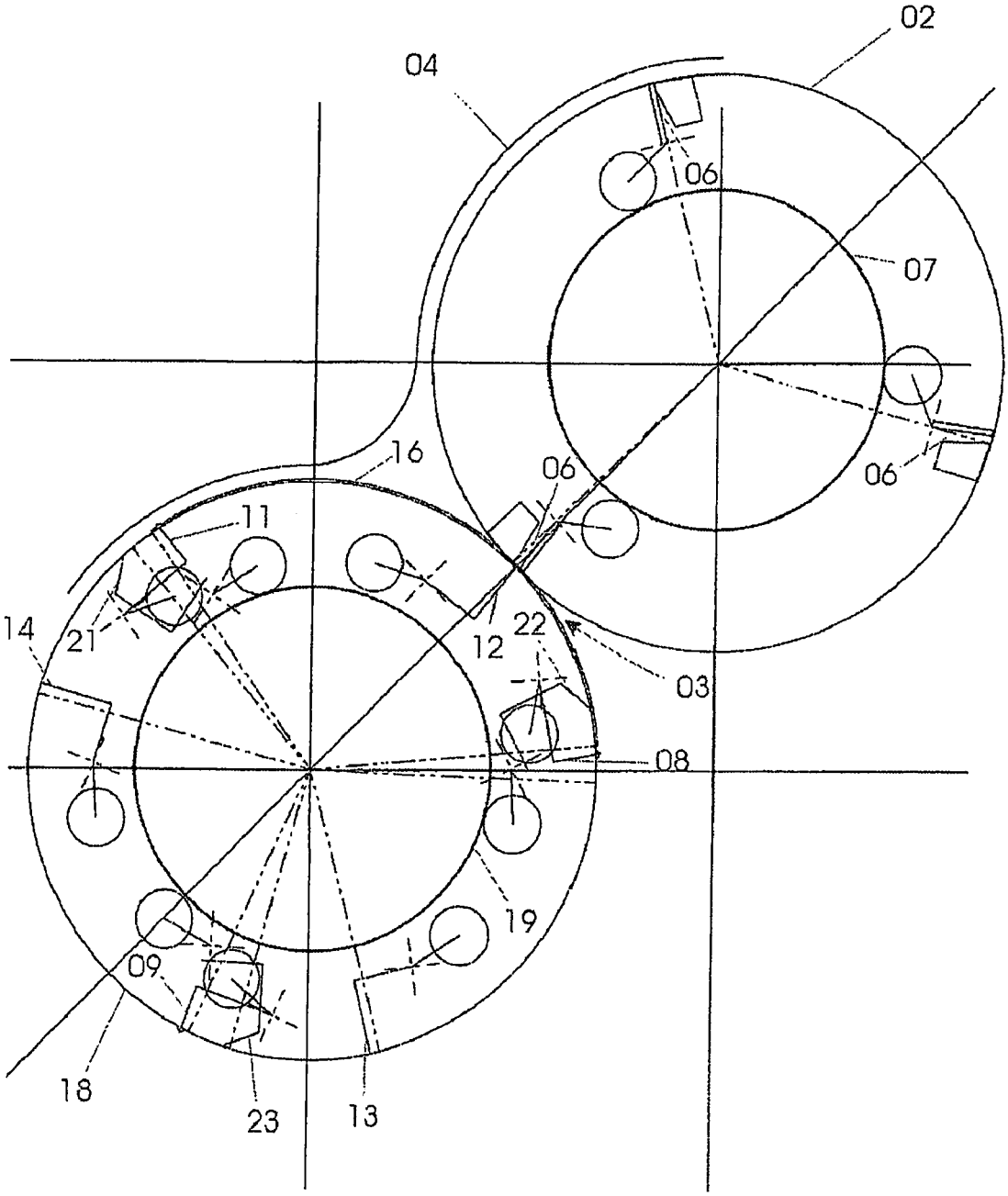

FIG. 4 shows a corresponding arrangement, consisting of the folding jaw cylinder 02 and a spur cylinder 18, in accordance with the present invention. In the arrangement shown in FIG. 4, like reference symbols correspond to like components, as were utilized in the previously discussed drawing figures, so that their explanation need not be repeated again. As can be seen in FIG. 4, deflectors 21, 22, 23 have been assigned to the three spur strips 08, 09, 11, respectively of the spur cylinder 18 and are each controlled by a common cam disk 19. The deflectors 21, 22, 23, which are here shown in the retracted state, are each strip-shaped sheet metal pieces, which can be extended from, and can be retracted into the spur cylinder 18. As may be seen in FIG. 6, and in greater detail in FIG. 7, each of the deflectors 21, 22, 23 has an inclined face 24 or deflector strip which is extending away from the shell face of the spur cylinder 18 opposite to a direction of rotation of the spur cylinder 01 The deflectors 21, 22, 23 can also be embodied in the form of a comb which ebodiment is not specifically depicted, to whose comb teeth individual spur needles 10, as seen in FIG. 7, of one of the spur strips 08, 09, 11 are assigned. It is also conceivable that the deflectors 21, 22, 23 could be made of metal, plastic, or a like material. All of the deflectors 21, 22, 23 are located circumferentially shortly in front of, or before an associated one of the spur strips 08, 09, 11, in the direction of rotation of the spur cylinder 18.

Figure 5:
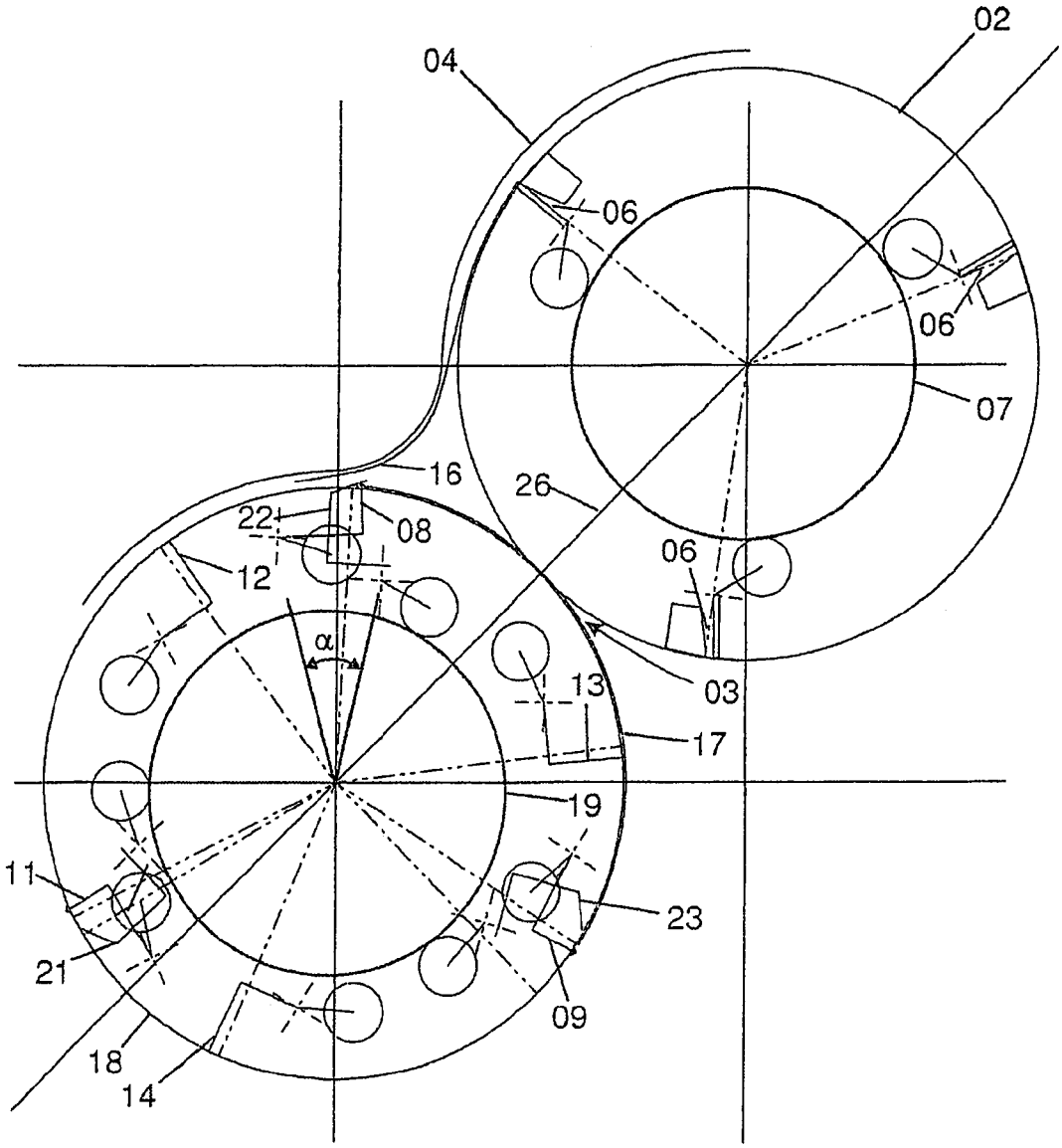

The situation immediately following the release of the first signature 16 from the shell face of the spur cylinder 18 is represented in FIG. 5. The spur needles 10 and the spur strip 11 have been retracted and the signature 16 has been released from spur strip 11. Thus, FIG. 5 shows a point in time which corresponds to the one shown in FIG. 3, in which the first signature 16 is completely released from the spur strip 11 and its previously leading end section moves in a retrograde direction with respect to the direction of rotation of the spur cylinder 18. In this situation, the deflector 22, which is assigned to the spur needles of the subsequent spur strip 08, is extended and its inclined face or deflector strip 24 shields the previously leading end section of the first signature 16 from the spur needles 10 of the subsequent spur strip 08.

Covering the spur needles 10, the inclined face or deflector strip 24 of each deflector 21, 22, 23 is arranged within an angular range $\alpha$ of between 30° to 45°, or from 30° to 60° in respect to a straight line 26 that is determined by the axes of rotation of the spur cylinder 18 and the folding jaw cylinder 02.

Figure 6:
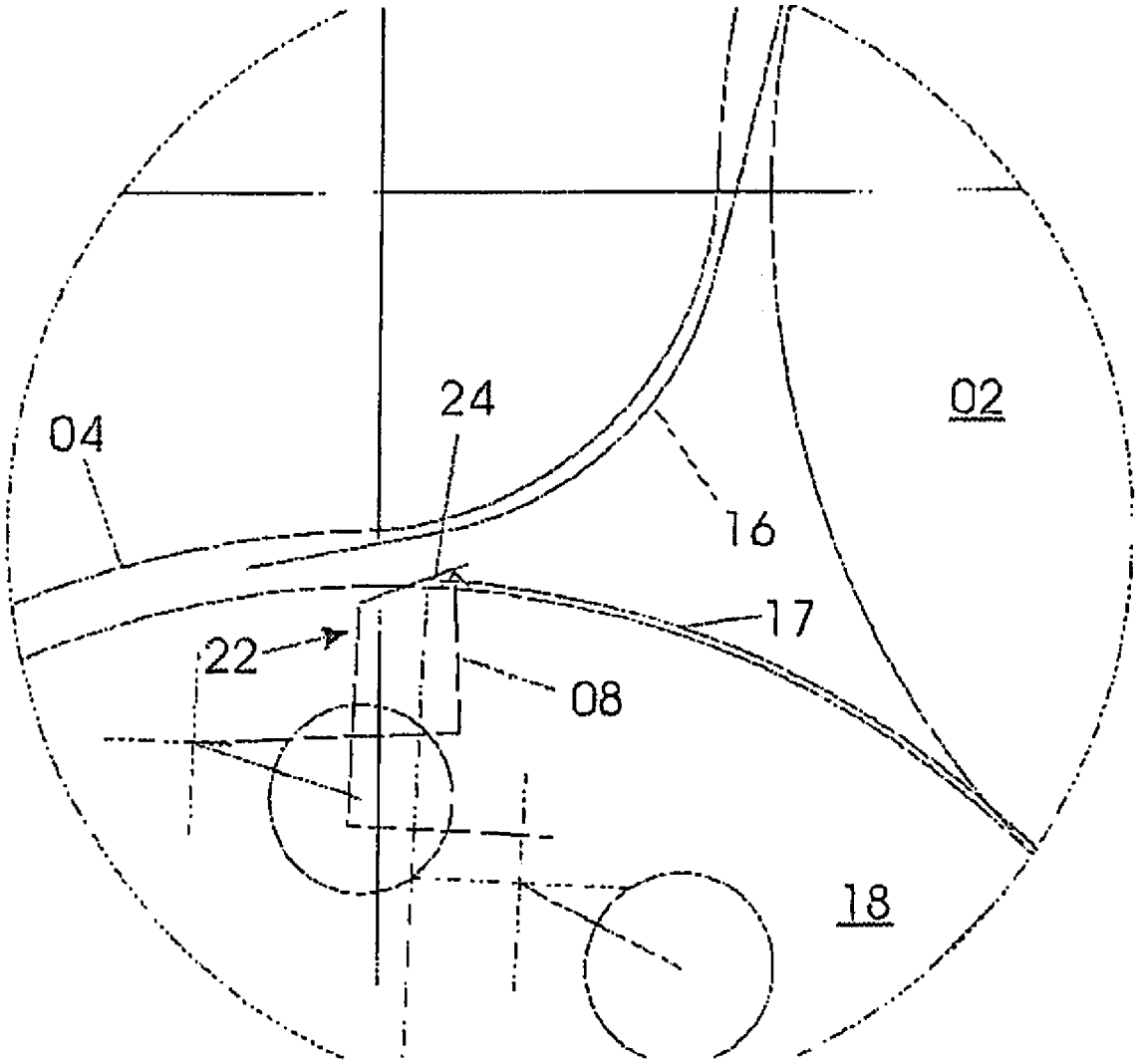
Figure 7:
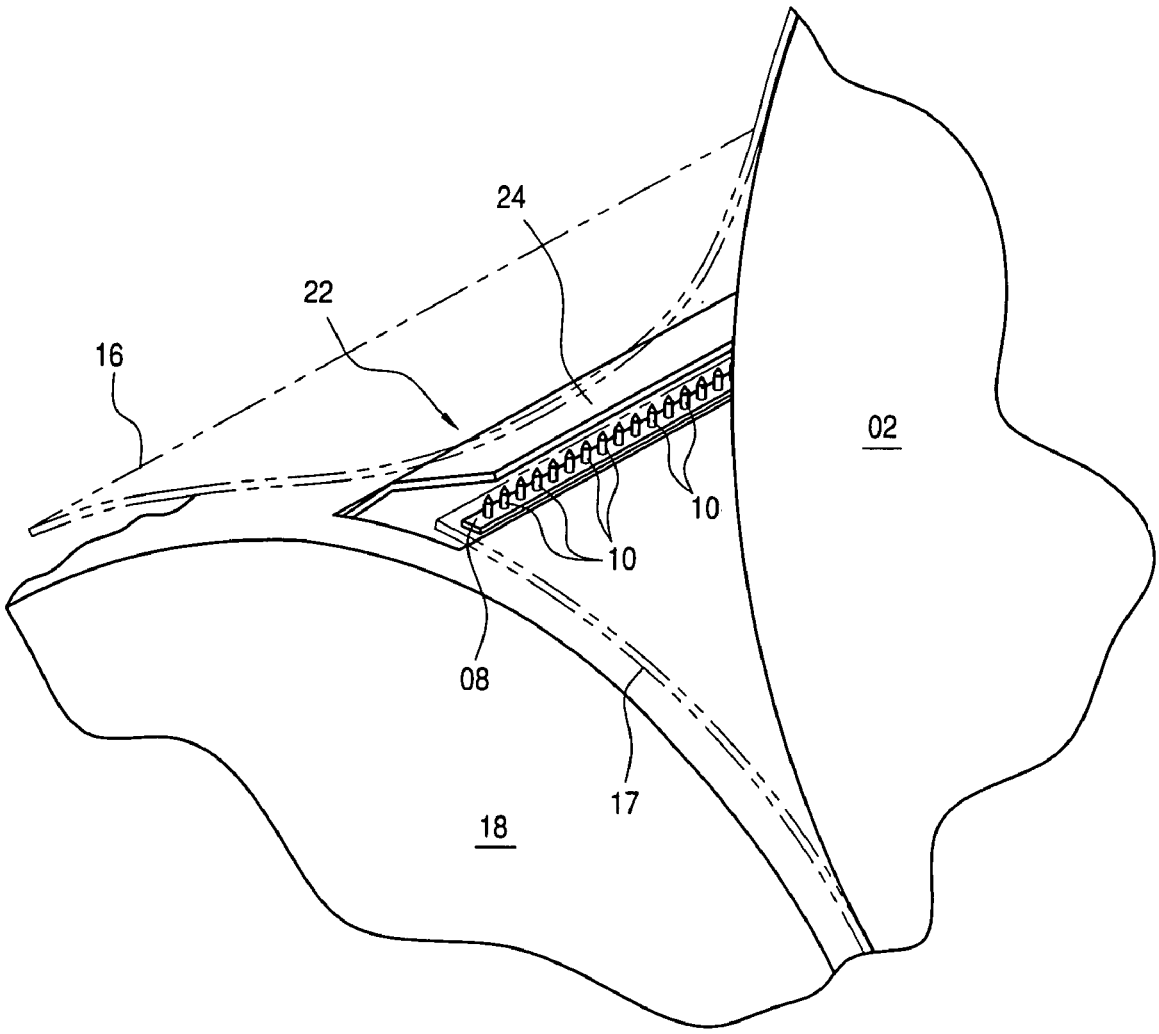

The critical area, in the surroundings of the previously leading signature end section, can again be seen, on an enlarged scale, in FIG. 6. and also in FIG. 7. At the time represented in both FIGS. 3 and 5, the spur needles 10 of the subsequent spur strip 08, which follow the spur needles 10 of the prior spur strip 11, have passed through the transfer gap 03 and are now located on the level of the now returning, previously leading end section of the first signature 16. The second signature 17, which follows the signature 16, is speared or impaled on the spur needles 10 of the second spur strip 08. The deflector 22 is extended and, in contrast to prior, generally-known spur cylinder 01, the inclined face or deflector strip 24 of the deflector 22 shields the previously leading end section of the first signature 16 from the spur needles 10 of the spur strip 08, which is subsequent in the direction of rotation of the spur cylinder 18, as well as in the radial direction. The deflector 22 is distinguished by a radial projection with regard to the spur needles 08. This projection enables the inclined face 24 of the deflector 22 to cover the spur needles 10 of the spur strip 08. Moreover, because of the inclined face 24, an easy sliding of the previously leading end section of the first signature 16, at the deflector 22, over the inclined face or deflector strip 24 and over spur needles 10 is possible.

The deflectors 21, 22, 23 are extended out of the spur cylinder 18 by the cam disks 19 at those times at which they have passed through the transfer gap 03. The deflectors 21, 22, 23 are again retracted into the spur cylinder 18 after the spur needles of the spur strips 08, 09, 11 respectively, to which they are assigned, have again been retracted into the spur cylinder 18.

While preferred embodiments of a puncture or spur needle cylinder provided with at least one puncture or spur needle strip, in accordance with the present invention, has been set forth fully and completely hereinabove, it will be apparent to one of skill in the art that various changes in, for example, the drives for the cylinders, the structure of the folding jaws, and the like could be made without departing from the true spirit and scope of the present invention which is accordingly to be limited only by the appended claims.

What is claimed is:

1. A folding apparatus comprising:

a spur cylinder having a spur cylinder circumferential shell surface and a first direction of rotation;

a folding jaw cylinder cooperating with said spur cylinder and defining a transfer gap in cooperation with said spur cylinder;

at least one spur strip on said spur cylinder and having a plurality of spur needles adapted to releasably hold leading ends of at least first and second signatures during passage of said at least one spur strip through said transfer gap, said plurality of spur needles selectively extending radially outwardly beyond said spur cylinder circumferential shell surface to releasably hold said leading end of each said signature during passage through said transfer gap and retracting radially inwardly beneath said spur cylinder circumferential shell surface to release said leading end of each said signature after passage through said cylinder gap for transfer of each said signature to said folding jaw cylinder;

at least one deflector on said spur cylinder and having a deflector strip usable selectively to cover said spur needles on said at least one spur strip, and to expose said spur needles on said at least one spur strip; and means for moving said at least one deflector between a spur needle exposing position, wherein said at least one deflector strip is retracted in said spur cylinder to expose said spur needles during passage of said spur needles and said leading end of each said signature through said transfer gap, and a spur needle covering position wherein said at least one deflector strip is extended radially from said spur cylinder and circumferentially with respect to said spur needle circumferential shell surface to cover said spur needles and a leading end of each said signature, said at least one deflector strip being movable from said spur needle exposing retracted position, during passage of said at least one spur strip and each said signature leading end through said transfer gap, to said spur needle covering extended position, covering said spur needles and each said signature leading end, in response to rotation of said spur cylinder and subsequent to passage of said at least one spur strip with each said signature leading end and said at least one deflector strip through said transfer gap, said at least one deflector strip, in said spur needle covering extended position shielding said extended spur needles from contact with a released leading end of a prior one of said signatures during retrograde movement of said prior signature leading end along said spur cylinder circumferential shell surface opposite to said spur cylinder direction of rotation.

2. The folding apparatus of claim 1 further including a second spur strip on said spur cylinder and wherein said at least one deflector strip, in said spur needle covering extended position, is arranged between a trailing end of said released prior signature, and extended spur needles of said second spur strip, said second spur strip engaging said second signature leading end and being located subsequent to said at least one spur strip on said spur cylinder in said direction of rotation of said spur cylinder.

3. The folding apparatus of claim 1 wherein said spur cylinder has an axis of rotation and further wherein said at least one deflector strip has a length which extends parallel to said spur cylinder axis of rotation.

4. The folding apparatus of claim 2 wherein said at least one deflector is positioned before, in said direction of rotation of said spur cylinder, said second spur strip.

5. The folding apparatus of claim 1 wherein said at least one spur strip and said at least one deflector strip are retracted after release of said leading end of each said signature after passage of said leading end of each said signature beyond said transfer gap.

6. The folding apparatus of claim 1 wherein said at least one deflector strip includes an inclined face, said inclined face of said at least one deflector strip extending radially from a shell face of said spur cylinder and circumferentially opposite to said direction of rotation of said spur cylinder.

7. The folding apparatus of claim 1 further including a straight line extending between axes of rotation of said spur cylinder and said folding jaw cylinder and said deflector, in said spur needle covering, extended position, being arranged within an angular range of between 30° and 60° with respect to said straight line and after said transfer gap in said direction of rotation of said spur cylinder.

8. The folding apparatus of claim 7 wherein said angular range is between 30° and 45°.

* * * * *